United States Patent [19]

Sherman

[11] 4,281,255

[45] Jul. 28, 1981

[54] SOURCE OF ENERGY AND A METHOD OF GENERATING ENERGY

[76] Inventor: Victor L. Sherman, 115 Logan St., Apt. 2D, Brooklyn, N.Y. 11208

[21] Appl. No.: 921,850

[22] Filed: Jul. 3, 1978

[51] Int. Cl.[3] ..... F25B 25/00; H02P 9/04

[52] U.S. Cl. ..... 290/1 R; 290/2; 60/517

[58] Field of Search ..... 290/4, 2, 44, 1 R, 11; 60/641, 516, 517

[56] References Cited

U.S. PATENT DOCUMENTS

| | | | |
|---|---|---|---|
| 1,785,643 | 12/1930 | Noack et al. | 290/4 |
| 3,234,395 | 2/1966 | Colgate | 290/1 |
| 3,451,342 | 6/1969 | Schwartzman | 60/641 X |
| 3,675,031 | 7/1972 | Lavigne | 290/1 |
| 3,788,091 | 1/1974 | Miller | 60/641 X |
| 3,788,092 | 1/1974 | Miller | 60/641 X |
| 3,875,435 | 4/1975 | Wang et al. | 60/516 X |
| 3,927,329 | 12/1975 | Fawcett et al. | 290/1 |
| 3,938,337 | 2/1976 | Fawcett et al. | 290/1 |
| 4,114,046 | 9/1978 | Yousef | 290/44 X |

*Primary Examiner*—B. Dobeck
*Attorney, Agent, or Firm*—Ilya Zborovsky

[57] ABSTRACT

A mover is provided having a housing and an element movable in the housing. Container means accommodates the gas which is heated under the action of a surrounding medium. The thus-heated gas is fed into the housing of the mover from the container means and expands in the housing so as to move the movable element. At the same time, the expanded gas is cooled and partially condensed. Then, a new portion of the gas is supplied into an opposite part of the housing and moves the movable element in an opposite direction. Thus, the gas, cooled and partially condensed in the previous step, is expelled from the housing of the mover and travels back into the container means wherein it is again heated under the action of the surrounding medium.

9 Claims, 1 Drawing Figure

SOURCE OF ENERGY AND A METHOD OF GENERATING ENERGY

BACKGROUND OF THE INVENTION

The present invention relates to a source and method of generating energy.

A plurality of sources of energy and methods of generating energy have been proposed and used in practice. The known sources and method are not satisfactory in some aspects.

SUMMARY OF THE INVENTION

Accordingly, it is an object of the present invention to provide a new source of energy and a new method of generating energy which have some advantages as compared with the prior art.

In keeping with these objects, and with others which will become apparent hereinbelow, one feature of the present invention resides in a source of energy arrangement which has a mover having a housing and an element movable in the housing, container means accommodating gas and so arranged that the gas is heated under the action of a surrounding medium, and communicating means communicating the container means with the housing of the mover. The gas heated in the container means is fed into the mover, expands therein and moves the movable element. At the same time, the gas is cooled during the expansion and partially condensed. Then, the gas is again fed from the container means in an opposite part of the mover and moves the movable element in an opposite direction. Thereby, the gas which has been cooled and partially condensed in the previous step is expelled by the movable element into the container means wherein the gas is again heated under the action of the surrounding medium. Another feature of the present invention is to provide a method of generating energy including the above-mentioned steps.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawing is a schematic view showing a source of energy arrangement in accordance with the present invention.

DESCRIPTION OF A PREFERRED EMBODIMENT

Figure 1:
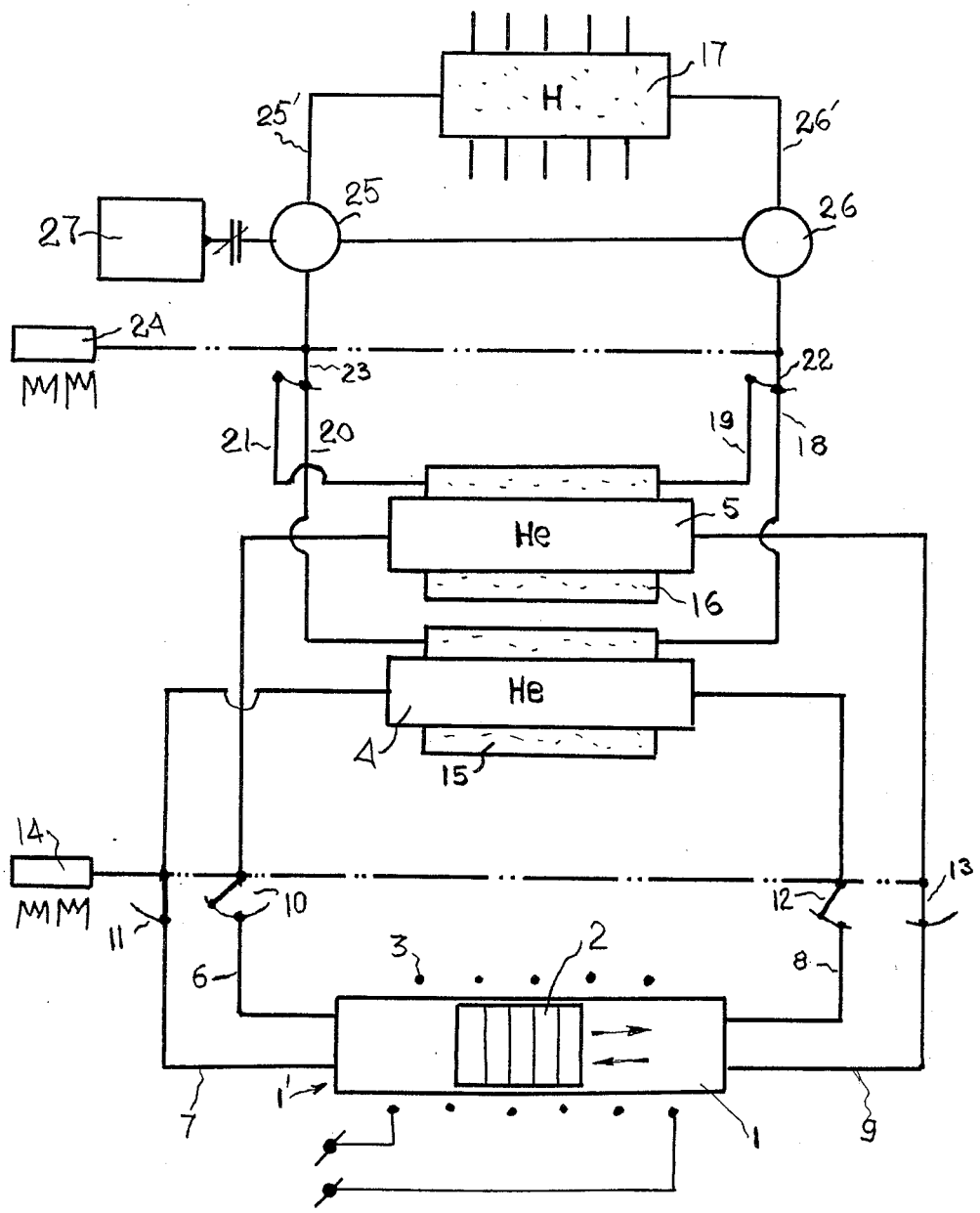

An energy source arrangement in accordance with the present invention has a mover which is indentified in toto by reference numeral 1 and has a housing 1 and an element 2 which is movable in an inner chamber bounded by the housing 1. A winding 3 may be wound about the housing 1 of the mover 1.

Two containers 4 and 5 are provided adapted to accommodate helium which is compressed to about 200–350 atm and cooled to about 20°–30° K. The containers 4 and 5 have heat-exchange elements, such as jackets 15 and 16 which bound inner passages. The containers 4 and 5 communicate with the housing 1 of the mover 1 by means of conduits 6–9 provided with valves 10–13, respectively. A control element 14, such as an electromagnet 14 operates for actuating the switches 10–13 so as to switch respective valves to respective positions thereof.

A receiver 17 accommodates a gaseous medium, such as hydrogen, which is compressed to some hundreds atmospheres. It communicates with the inner passages of the jackets 15 and 16 by means of conduits 18, 20 and 19, 21, respectively. The valves 22 and 23 are located in the conduits 18,19 and 20, 21, respectively. The valves 22 and 23 are actuated by a control element 24, such as an electromagnet, so as to move a respective one of these valves to a respective position.

A pump 26 is arranged in a conduit 26', and a motor 25 is arranged associated with a conduit 25'. The motor 25 is connected with a generator 27 so as to operate the latter.

The energy source arrangement operates in the following manner.

Hydrogen which is accommodated in the receiver 17 is heated under the action of a surrounding medium inasmuch as the receiver 17 is exposed to the latter. The thus-heated hydrogen is supplied from the receiver 17 into the jacket of the container 4 so as to heat helium which is accommodated in the container 4. This will be explained in detail later on. Helium which is compressed in the container 4 and heated to 20°–30° K. is fed from the container 4 through the conduit 7 into a left part of the housing 1 of the mover 1', as considered in the drawing. It expands and thereby moves the movable element or piston 2 to the right. At the same time, the expanded helium is cooled and partially condensed. After this, the valve 11 is switched off, whereas the valve 12 is switched on so that the compressed and heated helium is again fed from the container 4 through the conduit 8 into a right part of the housing 1 of the mover 1'. The thus-fed helium expands and moves the piston to the left. At the same time, it also is cooled and partially condensed in the right part of the housing. The helium which was accummulated in the left side of the housing during the previous step and is in cooled and partially condensed condition, is expelled by the piston 2 which now moves to the left and travels through the conduit 6 into the container 5. During the expansion of the helium admitted in both parts of the housing 1 and the movements of the piston 2 in the respective directions electric current is generated in the winding 3 which current can be supplied to a consumer. It is to be noted that the winding is constituted by a superconductive material.

As mentioned hereinabove, the receiver 17 accommodates hydrogen which is heated under the action of the surounding medium. The hydrogen is heated to gaseous state and is fed to the motor 25 so as to move a working element thereof, such as a rotor. The latter actuates the generator 27 which generates electric current to be supplied to a consumer. At the same time, the hydrogen becomes cooled in the motor 25 to a temperature which, however, is higher that that of the helium accommodated in the container 4. The thus-cooled hydrogen which is also partially compressed and is in gaseous state is supplied into the jacket 16 of the container 5 and heats the helium accommodated therein, e.g. received from the mover 1'. The hydrogen liquifies under the action of a heat exchange with the helium, whereas the helium evaporates and becomes heated and compressed. The heated and compressed helium is thereafter supplied from the container 5 through the conduit 9 so as to continue the process. The liquified hydrogen is pumped by the pump 26 into the receiver 17. Thus, the containers 4 and 5 perform their functions is an alternate order.

It is to be understood that the arrangement may have only one, or more than two containers for accommodating helium. The winding 3 may be ommitted so that the piston 2 performs displacement of an additional element to thereby perform a work. The receiver 17 may also serve for actuating an additional element, such as a steam engine in response to a temperature differential between the temperature of incoming cooled hydrogen in one part of the receiver and outgoing heated hydrogen in another part thereof. Energy which is released by gas when it is supplied into the mover in compressed state exceeds the energy which is needed for returning the gas into the container if the gas has at least partially condensed while expanding. The thus-produced differential of energy is compensated by the surrounding medium, particularly be means of absorption of heat in the receiver 17.

It will be understood that each of the elements described above, or two or more together, may also find a useful application in other types of constructions from the types described above.

While the invention has been illustrated and described as embodied in a particular source of energy and a method of generating energy, it is not intended to be limited to the details shown, since various modifications and structural changes may be made without departing in any way from the spirit of the present invention.

Without further analysis, the foregoing will so fully reveal the gist of the present invention that others can be applying current knowledge readily adapt it for various applications without ommitting features that from the standpoint of prior art, fairly constitute essential characteristics of the generic or specific aspects of the present invention.

What is claimed as new and desired to be protected by Letters Patent is set forth in the appended claims:

1. An energy source arrangement, comprising a mover having a housing;

container means accommodating helium, said container means being so arranged that the helium accommodated therein is heated under the action of surrounding medium, said container means including two containers each having two oppositely located openings;

communicating means communicating said container means with said mover so that the thus-heated helium travels through said communicating means from said container means into said housing of said mover wherein the helium expands and moves said movable element and during this the helium becomes cooled and partially condensed, said communicating means being further arranged so that the thus-cooled and partially condensed helium thereupon travels from said housing of said mover back into said container means without being externally cooled to be again heated in the latter under the action of the surrounding medium, said communicating means including four conduits each communicating one of said openings of one of said containers with said housing of said mover; and actuating means operative for actuating said communicating means so that the heated helium is fed from one of said containers through one of its openings into said mover to move said movable element in one direction whereby the helium is cooled and partially condensed, then the heated helium is fed through another opening from the same container into the housing of said mover so that it moves said movable element in an opposite direction and expels the cooled and partially condensed helium from said mover into one opening of another container wherein the helium is to be again heated to thereafter be fed through another opening of said other container into said housing of said motor.

2. An arrangement as defined in claim 1, wherein said movable element of said mover is constituted by a ferromagnetic material; and further comprising a winding which is wound about said housing of said mover so that electric current is generated in said winding when said movable element moves in said housing under the action of the gas received therein.

3. An arrangement as defined in claim 2, wherein said movable element is constituted by a material which has chracteristics of a permanent magnet.

4. An arrangement as defined in claim 1; and further comprising an additional element arranged for accommodating an additional gaseous medium and operative to heat said additional gaseous medium under the action of the surrounding medium and to thereafter supply the thus-heated additional gaseous medium into said containers to thereby heat the helium accommodated in the latter.

5. An arrangement as defined in claim 4, wherein each of said containers is provided with an outer jacket bounding a passage, said additional element communicating with said passages of said containers so that said additional gaseous medium travels from said additional element into said passages to thereby heat the helium accommodated in said containers.

6. An arrangement as defined in claim 5; and further comprising a motor, said additional element communicating with said motor so as to supply said additional gaseous medium to the latter whereby said motor is actuated whereas the additional gaseous medium is cooled during operation of said motor to a temperature which is higher than that of the helium accmmodated in said containers; and further comprising further communicating means arranged for communicating said motor with said passages of said containers so that said additional gaseous medium after being cooled in said motor travels into said passages of said containers to thereby heat the helium accmmodated in the latter due to the differential between the temperatures of the helium and the additional gaseous medium.

7. An arrangement as defined in claim 1, wherein said container means is arranged for accommodating helium cooled and compressed conditions.

8. An arrangement as defined in claim 1, wherein said additional element is arranged for accommodating hydrogen in compressed condition.

9. A method of generating energy, comprising the steps of providing a mover having a housing and an element which is movable in the housing;

accommodating helium in container means including two containers each having two oppositely located openings and provided with four conduits each communicating one of said openings of one of said containers with said housing of said mover;

heating the helium accommodated in the container under the action of surrounding medium;

supplying the thus-heated helium into said housing of said mover so that the helium expands and moves said movable element and at the same time the helium is cooled and partially condensed during the expansion; and withdrawing the thus-cooled and partially condensed helium from said housing of said mover into said container means without cooling by external cooling means so as to again heat the helium in the latter under the action of the surrounding medium, said supplying and withdrawing steps including feeding the heated helium from one of said containers through one of its openings into said mover to move said movable element in one direction whereby the helium is cooled and partially condensed, the feeding the heated helium through another opening from the same container into said housing of said mover so that it moves said movable element in an opposite direction and expels the cooled and partially condensed helium from said mover into one opening of another container wherein the helium is to be again heated to thereafter be fed through another opening of said other container into said housing of said mover.

* * * * *